US005409020A

United States Patent [19]

Belvederi

[11] Patent Number: 5,409,020

[45] Date of Patent: Apr. 25, 1995

[54] METHOD OF CONTROLLING TOBACCO FLOW ON CIGARETTE MANUFACTURING MACHINES

[75] Inventor: Bruno Belvederi, Pietro, Italy

[73] Assignee: G.D Societa Per Azioni, Italy

[21] Appl. No.: 225,503

[22] Filed: Apr. 11, 1994

Related U.S. Application Data

[63] Continuation of Ser. No. 865,990, Apr. 9, 1992, abandoned.

[30] Foreign Application Priority Data

Apr. 12, 1991 [IT] Italy ..... BO91A0115 U

[51] Int. Cl.[6] ..... A24C 5/14

[52] U.S. Cl. ..... 131/84.4; 131/84.1; 177/119

[58] Field of Search ..... 131/84.1, 84.4, 118; 177/22, 52, 60, 64, 119, 121; 493/39, 42, 45, 47-50; 198/959; 209/535, 239

[56] References Cited

U.S. PATENT DOCUMENTS

| | | | |
|---|---|---|---|
| 3,656,337 | 4/1972 | McDonald | 177/119 X |
| 4,548,215 | 10/1985 | Adebahr | 131/84.4 |
| 4,848,369 | 7/1989 | Siems | 131/84.4 |
| 4,860,772 | 8/1989 | Hensgen et al. | 131/84.4 X |
| 5,044,819 | 9/1991 | Kilheffer et al. | 177/119 X |

*Primary Examiner*—Jennifer Bahr
*Attorney, Agent, or Firm*—Klauber & Jackson

[57] ABSTRACT

A method of controlling tobacco flow on cigarette manufacturing machines, whereby a first stream of shredded tobacco, containing tobacco in excess of the required amount, is fed on a conveyor along a path extending through a shaving station where the excess tobacco is removed by shaving members cooperating with the first stream; the shaved-off tobacco being removed by a throwing device, which forms a jet of tobacco, at the output of the shaving station, directed on to a screen connected to a load cell for emitting a control signal varying according to the kinetic energy transmitted by the jet to the screen.

9 Claims, 2 Drawing Sheets

METHOD OF CONTROLLING TOBACCO FLOW ON CIGARETTE MANUFACTURING MACHINES

This application is a continuation of application Ser. No. 07/865,990, filed Apr. 9, 1992, now abandoned.

BACKGROUND OF THE INVENTION

The present invention relates to a method of controlling tobacco flow on cigarette manufacturing machines.

On cigarette manufacturing machines, shredded tobacco is supplied pneumatically on the underside of a suction belt on to which it is sucked to form a stream of tobacco, which is eventually fed on to a paper strip traveling at the same speed as the suction belt. Once the tobacco is fed on to the paper strip, this is rolled transversely about the tobacco to form a continuous rod which is subsequently cut into pieces.

On known machines of the aforementioned type, the tobacco stream formed on the suction belt normally contains more tobacco than is actually required for forming the continuous cigarette rod. The tobacco in excess, which provides for maintaining a uniform stream on the suction belt, is removed at a shaving station by known shaving discs, the position of which in relation to the suction belt varies continuously depending on the amount of tobacco removed. More specifically, the amount of tobacco removed is measured continuously to produce a variable control signal for so adjusting the position of the shaving discs as to bring the control signal back to a predetermined minimum value.

The tobacco shaved off is normally accumulated on a conveyor by which it is fed to a measuring station some distance from the shaving discs.

The presence of the conveyor between the shaving and measuring stations involves a number of drawbacks. In addition to causing a certain amount of delay in the detection and correction of a variation in the amount of tobacco removed, the conveyor, which is essential for recycling the shaved-off tobacco, poses real problems in terms of space when it comes to machines designed to simultaneously produce two or more cigarette rods, in which case, a separate conveyor is required for each cigarette rod.

SUMMARY OF THE INVENTION

It is an object of the present invention to provide a tobacco flow control method designed to overcome the aforementioned drawbacks.

According to the present invention, there is provided a method of controlling tobacco flow on cigarette manufacturing machines, said method comprising stages consisting in feeding, on a respective conveyor, at least a first stream of shredded tobacco, containing a quantity in excess of the required amount, along a path extending through a shaving station; in removing the excess tobacco at said shaving station, via shaving means cooperating with said first stream; and in producing a control signal depending on the amount of tobacco removed; characterized by the fact that said control signal is produced by continuously removing the shaved-off tobacco via throwing means for forming a jet of tobacco, at the output of the shaving station, directed towards measuring means comprising a screen for intercepting said jet, and weighing means supporting said screen and designed to emit said control signal, which varies according to the kinetic energy-transmitted by said jet of tobacco to said screen.

The above method preferably comprises a further stage consisting in compensating the control signal, for obtaining a final signal substantially independent of the instantaneous operating speed of the machine.

According to a preferred embodiment of the above method, the manufacturing machine comprises at least two conveyors for respective said first tobacco streams, and respective measuring means for each said first stream; the screen of each said measuring means being so oriented as to direct a respective said jet of tobacco on to a further single conveyor for forming a single second tobacco stream.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
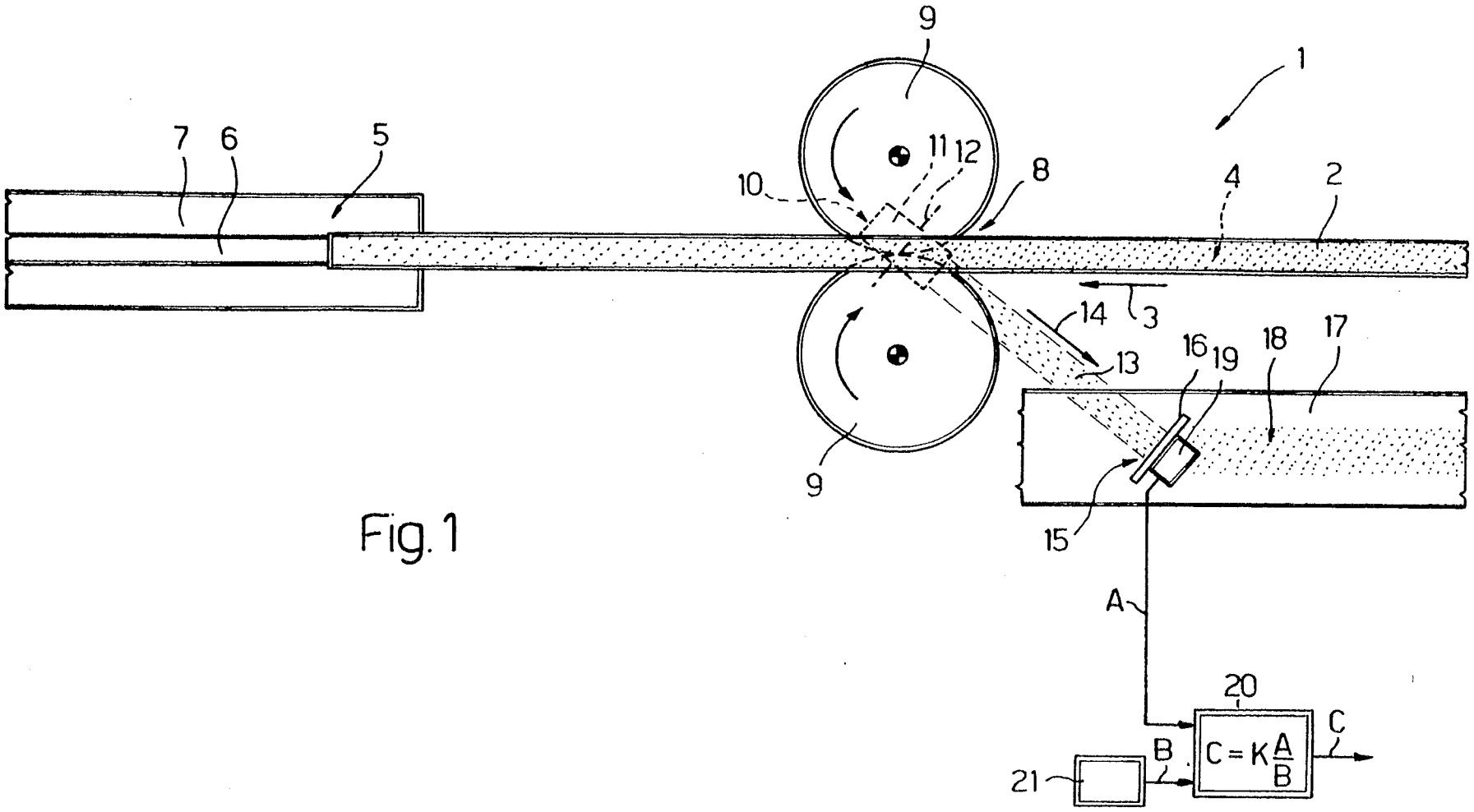
FIG. 1 shows a schematic plan view of a portion of a single-rod cigarette manufacturing machine implementing the method according to the present invention.

Number 1 in FIG. 1 indicates a cigarette manufacturing machine comprising a suction belt 2 on to the underside of which shredded tobacco is supplied continuously in known manner and fed in direction 3 to form a stream of tobacco 4. Tobacco stream 4 is fed on belt 2 to an unloading station 5 where it is fed in known manner on to a paper strip 6 traveling in known manner along a beam 7 for forming a continuous cigarette rod (not shown).

On the way to unloading station 5, stream 4 is fed through a shaving station 8 defined, in known manner, by two discs 9 rotating in opposite directions about respective substantially parallel axes perpendicular to the FIG. 1 plane. Discs 9 present cutting edges, and are arranged tangent to each other at a variable distance beneath belt 2, for shaving off stream 4 the tobacco in excess of that required for forming a substantially uniform continuous cigarette rod (not shown).

Shaving station 8 also comprises a throwing device 10 consisting of a substantially cylindrical brush 11 mounted underneath discs 9, at the point of tangency of discs 9 beneath belt 2, and rotating about an axis 12 substantially parallel to the FIG. 1 plane and slanting in relation to direction 3 of belt 2, at a speed proportional to the traveling speed of belt 2 in direction 3. As machine 1 operates, brush 11, rotating beneath discs 9, removes the tobacco shaved off by discs 9 and forms it into a jet 13 directed in direction 14, perpendicular to axis 12, towards a weighing device 15. Device 15 comprises a screen 16 so positioned over a conveyor 17 as to intercept jet 13 and accumulate the tobacco on conveyor 17, which provides for forming a stream 18 of shaved-off tobacco, which is directed to any recirculating point (not shown) on machine 1 as required.

Screen 16 is connected to weighing means comprising a load cell 19 for emitting a signal A relative to the kinetic energy transmitted by jet 13 to screen 16, and supplying it to a first input of a known amplifying device 20, the second input of which is connected to an emitter 21 for emitting a signal B proportional to the square of the traveling speed of belt 2, and the output of which supplies a signal C equal to:

$$C=KA/B$$

where K is the amplification constant.

Signal C is thus proportional to signal A and inversely proportion to signal B, i.e. substantially proportional to the amount of tobacco removed, and is employed in known manner for optimizing tobacco stream 4 at the output of shaving station 8.

Signal C therefore provides for immediately determining the amount of tobacco shaved off at station 8, and for immediate, substantially real-time correction of any departure from a given optimum value of output stream 4 from station 8.

Figure 2:
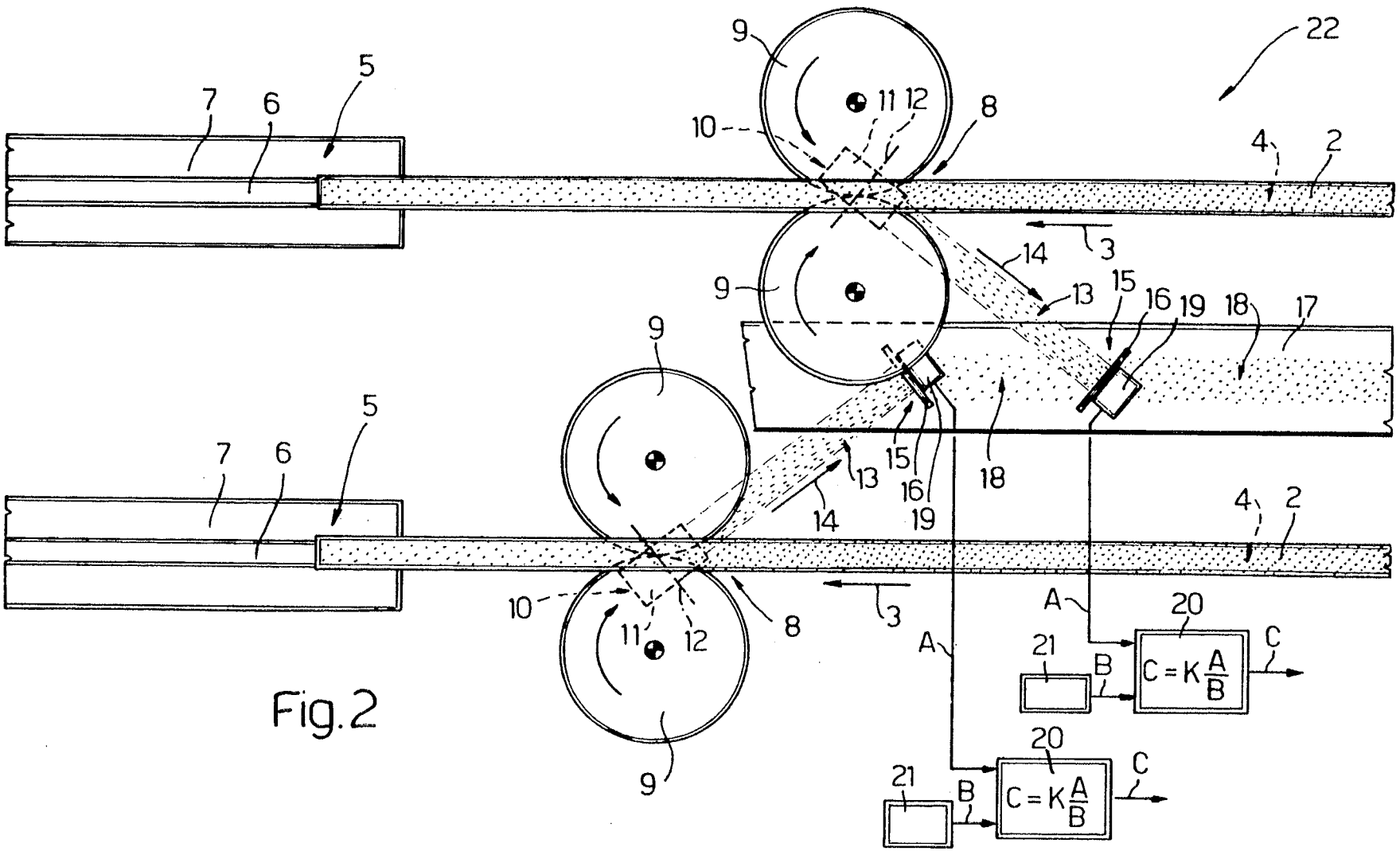
FIG. 2 shows a schematic plan view of a portion of a dual-rod cigarette manufacturing machine implementing the method according to the present invention.

The FIG. 2 variation relates to a multiple-rod, in this case a dual-rod, manufacturing machine 22 comprising two substantially parallel suction belts 2 for feeding respective streams 4 through respective shaving stations 8, each with a weighing device 15. In this case, however, screens 16 of weighing devices 15 are so arranged as to accumulate the shaved-off tobacco on a single recirculating conveyor 17. By virtue of the design of weighing device 15 in FIG. 2, the recirculating facility of machine 22, or any other type of multiple-rod machine, occupies no more space than that of a single-rod machine.

I claim:

1. A method of controlling tobacco flow on cigarette manufacturing machines (1; 22), said method comprising the steps of feeding, on a respective conveyor (2), at least a first stream (4) of shredded tobacco, containing a quantity in excess of the required amount, along a path extending through a shaving station (8); removing the excess tobacco at said shaving station (8), via shaving means (9) cooperating with said first stream (4) to form shaved-off tobacco corresponding to the excess tobacco and producing a tobacco-flow control signal (A) depending on the amount of the shaved-off tobacco; the control signal (A) being produced by continuously removing the shaved-off tobacco via the throwing means (10) receiving the shaved-off tobacco from the output of the shaving means (9) and forming a jet (13) of thrown tobacco, at the output of the shaving station (8), directed towards measuring means (15) comprising a screen (16) for deflecting said thrown jet (13), and load cell means (19) connected to said screen (16) for generating a control signal (A), which varies according to the kinetic energy transmitted by said jet (13) of thrown tobacco impacting upon said screen (16) and wherein said control signal (A) is ratioed to a second signal (B) which is a function of the speed of the conveyor (2) to provide a third signal (C) which is proportional to said control signal (A) and inversely proportional to said second signal (B), thereby being proportional to the amount of tobacco removed; and wherein said third signal (C) is used to effect real-time corrections of departures of the stream (4) of the tobacco from a given value.

2. A method as claimed in claim 1, wherein said throwing means (10) throws the shaved-off tobacco as a jet toward said screen at a speed which is a function of an instantaneous operating speed of said machines (1; 22).

3. A method as claimed in claim 2, wherein said second signal (B) is proportional to the square of the traveling speed of said first stream (4) through said shaving station (8).

4. A method as claimed in claim 1, comprising a further stage of deflecting said jet of thrown tobacco, by means of said screen (16), on to a second conveyor located adjacent to the first conveyor on which the shaved-off tobacco in said jet of thrown tobacco is accumulated to form a second stream (18) of tobacco that is recirculated.

5. A method as claimed in claim 3, wherein said machines (22) each comprise at least two said conveyors (2) for respective said first streams (4) of tobacco, and respective said measuring means (15) for each said first stream (4); the screen (16) of each said measuring means (15) being so oriented as to deflect a respective said jet (13) of thrown tobacco onto a second conveyor (17) for forming a single said second stream (18) of tobacco.

6. The method as claimed in claim 1 wherein said throwing means comprises a substantially cylindrical brush mounted beneath the shaving means and in the path of the shaved-off tobacco falling from the shaving means.

7. A method of controlling tobacco flow on a cigarette manufacturing machine (1; 22), the method comprising the steps of feeding, on a respective conveyor (2), at least a first stream (4) of shredded tobacco, containing a quantity in excess of the required amount, along a path extending through a shaving station (8); removing the excess tobacco at said shaving station (8), via shaving means (9) cooperating with said first stream (4) to form shaved-off tobacco corresponding to the excess tobacco; using a throwing means to throw the shaved-off tobacco as a jet from the shaving station to a second conveyor (17) onto which the excess tobacco is deflected and accumulated; and continuously measuring the kinetic energy imparted by the impact of the shaved-off tobacco upstream from the second conveyor (17) using a load cell to produce a control signal (A) depending on the amount of the shaved-off tobacco, which control signal (A) is ratioed to a second signal (B) which is a function of the speed of the conveyor (2) to provide a third signal (C) which is proportional to said control signal (A) and inversely proportional to said second signal (B), thereby being proportional to the amount of tobacco removed; and wherein said third signal (C) is used to effect. real-time corrections of departures of the stream (4) of the tobacco from a given value.

8. A method as claimed in claim 7, wherein said control signal (A) is produced by continuously throwing the shaved-off tobacco from the shaving station (8) and on to measuring means (15) arranged upstream from the second conveyor (17) and comprising a screen (16) for deflecting the [ejected]thrown shaved-off tobacco on to the second conveyor (17) where it is accumulated, and a load cell means (19) connected to said screen (16) and designed to emit said control signal (A), which varies according to the kinetic energy transmitted by the thrown shaved-off tobacco impacting said screen (16).

9. A method as claimed in claim 8, wherein the shaved-off tobacco is ejected from the shaving station by means of rotary throwing means (10) receiving the shaved-off tobacco from the shaving means (9) and forming a jet (13) of tobacco, at the output of the shaving station (8), directed towards said screen (16); said throwing means (10) throwing the shaved-off tobacco towards said screen at a speed which is a function of an instantaneous operating speed of said machine (1; 22).

* * * * *